United States Patent [19]

Gotou

[11] Patent Number: 4,915,679

[45] Date of Patent: Apr. 10, 1990

[54] MANUFACTURING METHOD OF PLEATED MULTILAYER BAG

[75] Inventor: Toyokichi Gotou, Souka, Japan

[73] Assignee: Newlong Machine Works, Ltd., Tokyo, Japan

[21] Appl. No.: 269,764

[22] Filed: Nov. 10, 1988

[30] Foreign Application Priority Data

Jun. 4, 1988 [JP] Japan ..... 63-136645

[51] Int. Cl.[4] ..... B31B 39/02; B31B 39/26

[52] U.S. Cl. ..... 493/217; 493/248; 493/381; 493/386; 156/201; 156/204

[58] Field of Search ..... 493/210, 217, 248, 381, 493/386, 439, 294, 243; 156/200, 201, 204, 212, 213, 226, 227

[56] References Cited

U.S. PATENT DOCUMENTS 3,183,797 5/1965 Boone ..... 493/217

FOREIGN PATENT DOCUMENTS 46-1749 3/1971 Japan .
58-52834 11/1983 Japan .

*Primary Examiner*—D. S. Meislin
*Assistant Examiner*—Jack W. Lavinder
*Attorney, Agent, or Firm*—Lowe, Price, LeBlanc, Becker & Shur

[57] ABSTRACT

In a method of manufacturing a pleated multi-layer bag, a tubular synthetic resinous film collapsed flatly, with each side edge of the film folded inwardly to form a pair of pleats extending along the side edge, is laid upon a length of an outer-layer bag material. The film and the bag material are transported while one of the pair of pleats at each side edge of the film is set upright to form an upstanding section. Subsequently, opposite side portions of the outer-layer bag material are folded back toward the tubular synthetic resinous film. The upstanding section is folded down toward the other pleat. A part of each of the opposite side portions is forced into a space between the upstanding section and the other pleat at a corresponding one of the opposite side edges of the tubular synthetic resinous film. The opposite side portions of the outer-layer bag material are folded over the tubular synthetic resinous film in such a manner that the opposite side portions extend along the outer surface of the film. The resinous film and outer-layer bag material are then united and selected lengths thereof cut and sealed at one end to form bags. The method maintains the tubular synthetic resinous film in its collapsed state through the various steps, thereby avoiding entry of dirt, germs or bacterial into the bag as it is being manufactured.

8 Claims, 5 Drawing Sheets

MANUFACTURING METHOD OF PLEATED MULTILAYER BAG

BACKGROUND OF THE INVENTION

1. Field of the Invention

The present invention relates to a method of manufacturing a pleated multilayer bag having an inner layer formed of a tubular synthetic resinous film.

2. Background of the Prior Art

A method of a pleated multilayer bag is known from Japanese Patent Publication No. 58-52834, in which opposite side edges of a tubular plastic film are wrapped up by an outer-layer bag material, while the outer-layer bag material and the pleats of the tubular plastic film are superimposed upon each other in a close contact relationship.

Further, a method is also known from Japanese Patent Publication No. 46-1749, in which a periphery of an inner plastic layer is wrapped up by an outer paper layer, while gores are formed on both sides of the outer paper layer and the inner plastic layer.

In the method disclosed in the above Japanese Patent Publication No. 48-52834, the tubular plastic film is drawn into a rectangular cross-sectional tube forming device comprising an outer group of rolls and an inner group of rolls, in such a manner that the inner group of rolls are arranged within the tubular plastic film. A lower side of the outer-layer bag material superimposed upon a lower side of the tubular plastic film is caused to pass, together with a lower portion of the tubular plastic film, through a nip between a lower roll of the outer group of rolls and a lower roll of the inner group of rolls. The tubular plastic film is further drawn into the forming device while the opposite side edges of the outer-layer bag material are covered by upper rolls of the outer group of rolls to form pleats on the opposite side walls of the multilayer rectangular cross-sectional tube. Thus, the rectangular tube forming device is required for the method of the above Japanese patent, in order to form the tubular plastic film into the rectangular cross-sectional tube. Accordingly, the arrangement for carrying out the method is complicated in construction. Further, when the tubular plastic film is formed into the rectangular cross-sectional tube by the rectangular tube forming device, dust, various germs and the like are penetrated together with air into the tubular plastic film, causing a sanitary problem.

In the method disclosed in the above Japanese Patent Publication No. 46-1749, rotating air-needles are provided to form perforations in the inner plastic layer of the multilayer bag in a periodical manner from the outside, and air is supplied through the perforations to inflate the inner plastic layer. Thus, the air-needle, a gas supply mechanism and the like for supplying the air into the inner plastic layer are required for the arrangement for carrying out the method. Accordingly, the arrangement is complicated in construction. Moreover, there is such a concern that the dust, various germs or the like will penetrate together with air into the tubular plastic film, causing a sanitary problem.

SUMMARY OF THE INVENTION

It is an object of the invention to provide a method of manufacturing a pleated multilayer bag, in which one of a pair of pleat crests on each side of a synthetic resinous film is stood up to form an upstanding section, and a part of an outer-layer bag material is forced into a space between the upstanding section and the other pleat crest to form a folded-in section on each side of the outer-layer bag material, thereby carrying out continuous manufacturing of the pleated multilayer bag to bring the folded-in section on each side of the outer-layer bag material into close contact uniformly with a root between the pleats on a corresponding one of the opposite side edges of the tubular synthetic resinous film, whereby the rectangular tube forming device for forming the tubular synthetic resinous film into a rectangular cross-sectional tube, the air-needle and the air supply mechanism for supplying air into the tubular synthetic resinous film, and the like, are wholly dispensed with, enabling the construction to be simplified, and since no air is fed into the tubular synthetic resinous film, there is no such anxiety that the dust, various germs and the like penetrate together with the air into the tubular synthetic resinous film, making it always possible to use the tubular synthetic resinous film always in a sanitary manner.

According to the invention, there is provided a method of manufacturing a pleated multilayer bag, comprising the steps of: preparing a tubular synthetic resinous film collapsed flatly, each of opposite side edges of the tubular synthetic resinous film being folded inwardly to form a pair of pleats extending along the side edge; superimposing the tubular synthetic resinous film upon an outer-layer bag material; transporting the tubular synthetic resinous film and the outer-layer bag material which are superimposed one upon the other, while setting one of the pair of pleats at each side edge of the tubular synthetic resinous film upright to form an upstanding section; subsequently, folding back opposite side portions of the outer-layer bag material respectively toward the upstanding sections at the respective side edges of the tubular synthetic resinous film; folding down the upstanding section at each side edge of the tubular synthetic resinous film toward the other pleat at the side edge; forcing a part of each of the opposite side portions of the outer-layer bag material, into a space between the pair of pleats at a coresponding one of the opposite sides edges of the outer-layer bag material; and folding the opposite side portions of the outer-layer bag material over the tubular synthetic resinous film in such a manner that the folded side portions of the outer-layer bag material extend along an outer surface of the tubular synthetic resinous film.

The tubular synthetic resinous film is transported in such a manner that the upstanding sections are inserted respectively into a pair of engaging grooves defined respectively between a pair of lower guide plates and a pair of side guide plates. The upstanding sections at the respective side edges of the tubular synthetic resinous film are caused to pass respectively through a pair of recesses which open downward. Each of the pair of recesses is defined by a support frame which is mounted to an upper surface of a corresponding one of the pair of lower guide plates and an upper surface of a corresponding one of the pair of side guide plates. The upstanding section at each side edge of the tubular synthetic resinous film is further transported while being supported by a bent section of a corresponding one of a pair of inner support plates. The inner support plate is mounted to the upper surface of a corresponding one of the pair of lower guide plates. The inner support plate is arranged adjacent and along an outer side edge of the lower guide plate, which is located adjacent to a corresponding one of the pair of side guide plates.

The upstanding sections at the respective side edges of the tubular synthetic resinous film are further transported while being supported respectively by a pair of outer support frames. Each of the pair of outer support frames extends from a corresponding one of the pair of side guide plates so as to cover an outer side edge of a corresponding one of the pair of engaging grooves and an area above the engaging groove, the outer side edge of the engaging groove being located adjacent to the side guide plate. The upstanding sections at the respective side edges of the tubular synthetic resinous film are folded down respectively toward the opposite side portions of the outer-layer bag material, along and by respective slopes of a pair of engaging flare members. The part of each of the opposite side portions of the outer-layer bag material is forced into the space between the upstanding section and the other pleat at a corresponding one of the opposite side edges of the tubular synthetic resinous film, by a corresponding one of a pair of rotary rolls.

The part of each of the opposite side portions of the outer-layer bag material is further forced into the space between the upstanding section and the other pleat at a corresponding one of the opposite side edges of the tubular synthetic resinous film, by another rotary roll. The upstanding section at each of the opposite side edges of the tubular synthetic resinous film is folded down by a corresponding one of the pair of upper guide plates, toward a crest in the other pleat at the side edge of the tubular synthetic resinous film. The opposite side portions of the outer-layer bag material are folded respectively over the pair of upper guide plates.

The pair of engaging flare members are mounted respectively on the pair of upper guide plates or on the pair of lower guide plates. If the engaging flare members are mounted respectively on the pair of lower guide plates, the upstanding section at each side edge of the tubular synthetic resinous film is further folded down toward a crest in the other pleat at the side edge of the tubular synthetic resinous film, by a corresponding one of a pair of engaging guide pieces mounted respectively on the pair of lower guide plates.

All of the steps of the method of the present invention are carried out while the tubular synthetic resinous film, including both pleats on each side are maintained in their collapsed state, to avoid entry of dirt or germs with air into the bag during its manufacture.

BRIEF DESCRIPTION OF THE DRAWINGS

FIG. 4-*b* is a cross-sectional view taken along the line B—B in FIG. 2;

FIG. 4-*c* is a cross-sectional view taken along the line C—C in FIG. 2;

FIG. 4-*d* is a cross-sectional view taken along the line D—D in FIG. 2;

FIG. 4-*e* is a cross-sectional view taken along the line E—E in FIG. 2;

FIG. 4-*f* is a cross-sectional view taken along the line F—F in FIG. 2;

DETAILED DESCRIPTION

Embodiments of the invention will be described below with reference to the drawings.

Figure 1:
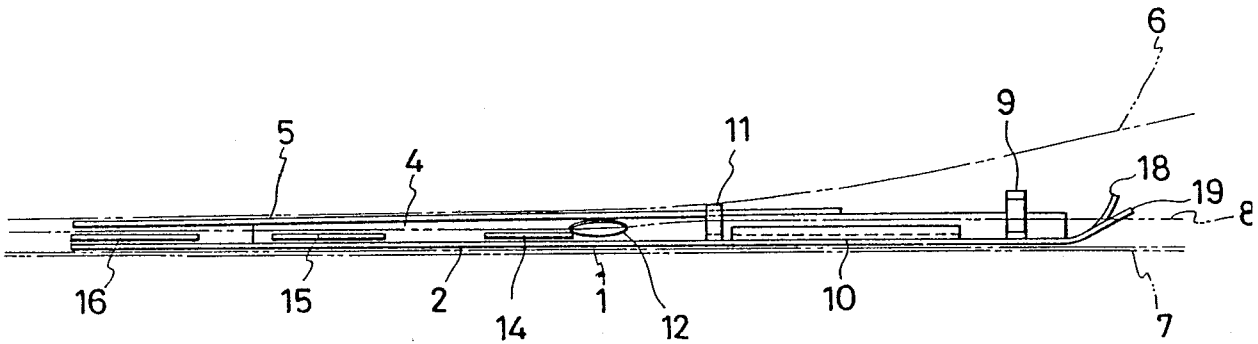
FIG. 1 is a front elevational view of a bag manufacturing device for use in carrying out a bag manufacturing method according to the invention.
Figure 2:
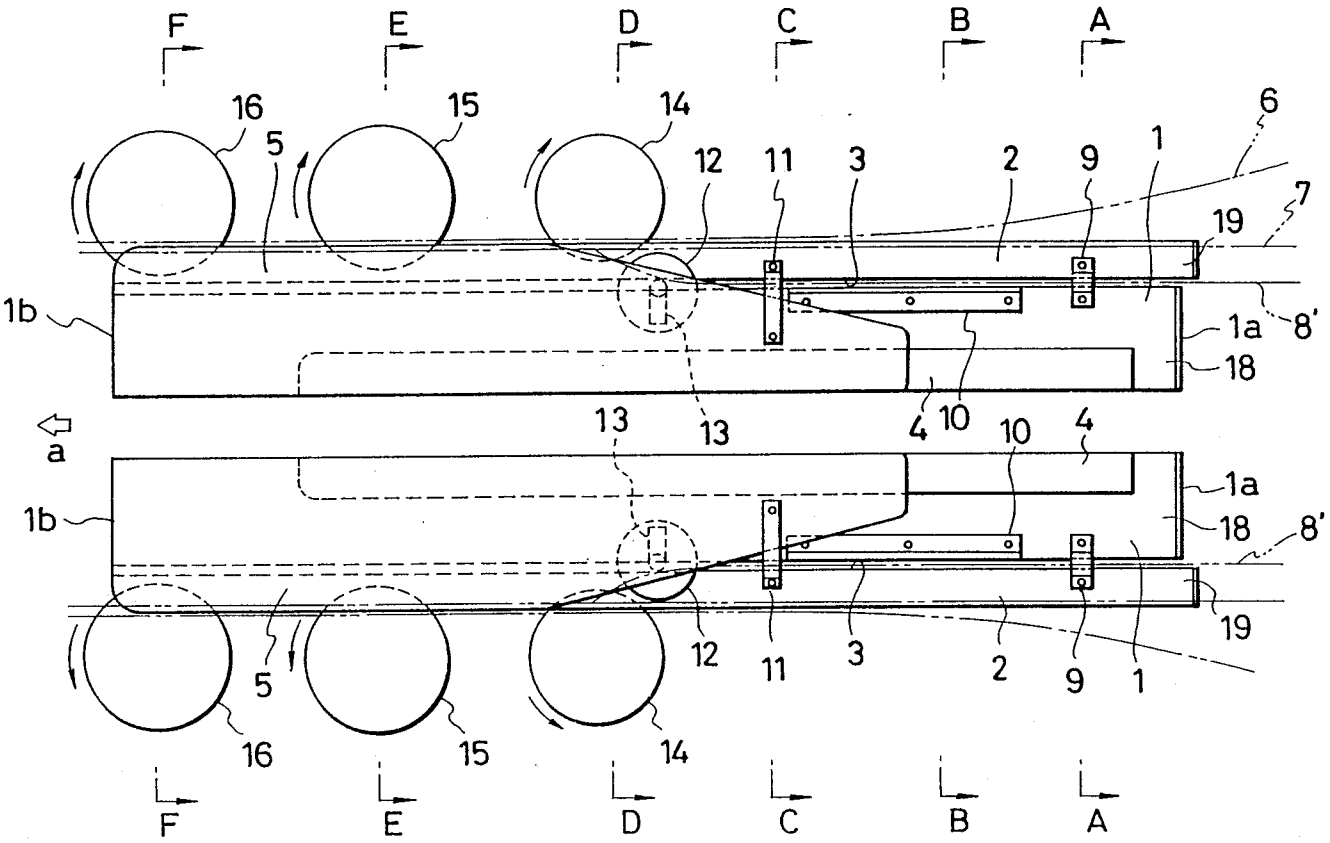
FIG. 2 is a top plan view of the bag manufacturing device illustrated in FIG. 1.

Referring to FIGS. 1 and 2, there is shown a bag manufacturing device for use in carrying out a bag manufacturing method according to the invention. The bag manufacturing device comprises a pair of lower elongated guide plates 1 and 1 which are spaced at a predetermined distance from each other and which are arranged in parallel relation to each other. A pair of side guide plates 2 and 2 are arranged respectively along outer side edges of the respective lower guide plates 1 and 1 in parallel relation thereto. A pair of engaging grooves 3 and 3 are defined respectively between the pair of lower guide plates 1 and 1 and the pair of side guide plates 2 and 2. A pair of support members 4 and 4 are mounted respectively on upper surfaces of the respective lower guide plates 1 and 1. The pair of support members 4 and 4 are arranged respectively adjacent to inner side edges of the respective lower guide plates 1 and 1 and extend respectively along the inner side edges thereof. A pair of upper guide plates 5 and 5 are mounted respectively on the support members 4 and 4. Each upper guide plate 5 is so arranged as to cover a portion of a corresponding one of the pair of lower guide plates 1 except for the remaining portion thereof adjacent to one end 1*a* of the lower guide plate 1, and so as to cover a portion of a corresponding one of the pair of side guide plates 2 except for the remaining portion thereof adjacent to the one end 1*a* of the lower guide plate 1.

Figure 3:
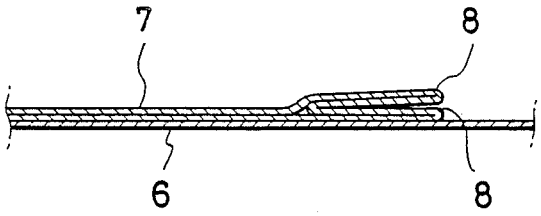
FIG. 3 is a fragmentary enlarged cross-sectional view showing an arranged state of an outr-layer bag material and a tubular synthetic resinous film.
Figure 4A:
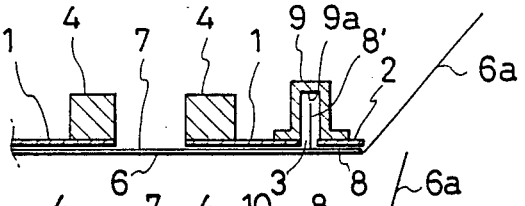
FIG. 4-*a* is a cross-sectional view taken along the line A—A in FIG. 2.
Figure 4B:
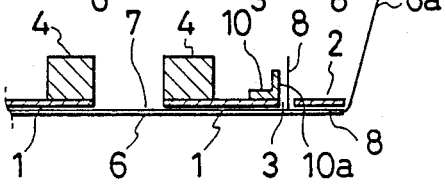
Figure 4C:
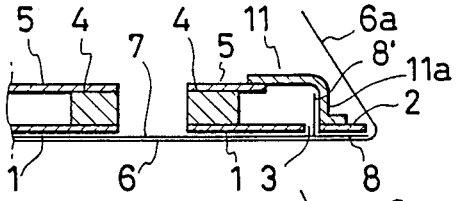
Figure 4D:
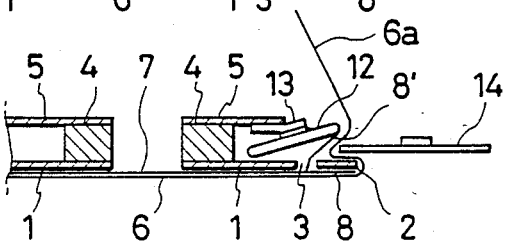
Figure 4E:
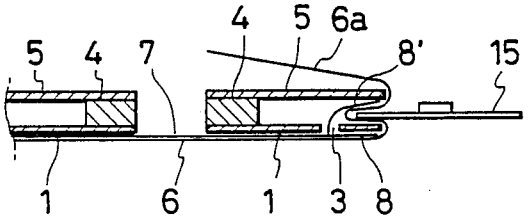
Figure 4F:
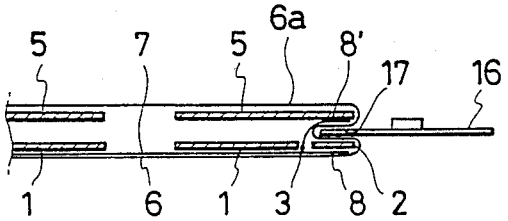

A tubular synthetic resinous film 7 collapsed flatly is superimposed upon an outer-layer bag material 6 formed of kraft paper. The outer-layer bag material 6 and the tubular synthetic resinous film 7 superimposed one upon the other are transported continuously by transport means (not shown) in a direction indicated by an arrow a in FIG. 2, from the one end 1*a* of the respective lower guide plates 1 toward their respective other ends 1*b*, along the lower guide plates 1, the side guide plates 2 and the upper guide plates 5. As shown in FIG. 3, each of the opposite side edges of the tubular synthetic resinous film 7 is deformed or folded inwardly to form a pair of pleat crests 8 and 8 which extend along the side edge. An outer periphery of the tubular synthetic resinous film 7 is adapted to be wrapped up by the outer-layer bag material 6. One of the pair of pleat crests 8 and 8 at each side edge of the tubular synthetic resinous film 7 is set upright to form an upstanding section 8'. The upstanding section 8' is inserted into the engaging groove 3 and is guided thereby. A table (not shown) is arranged below the lower guide plates 1 and the side guide plates 2.

An assembly including one of the pair of lower guide plates 1 and 1, a corresponding one of the pair of side guide plates 2 and a corresponding one of the pair of upper guide plates 5 is identical in construction with an assembly including the other lower guide plate 1, and the side guide plate 2 and the upper guide plate 5 which are associated with the other side guide plate 1. Accordingly, only one of these two assemblies, and one side portion of the outer-layer bag material 6 and one side edge of the tubular synthetic resinous material, which are associated with the one assembly, will be described below.

A support frame 9 for supporting, from both sides, the upstanding section 8' of the tubular synthetic resinous film 7 is mounted on the upper surfaces of the respective lower and side guide plates 1 and 2, at a location adjacent to the one end 1*a* of the lower guide plate 1 so as to straddle the engaging groove 3. An inner support plate 10 is mounted on the upper surface of the lower guide plate 1 at a location downstream of the support frame 9 with reference to the transport direction a of the outer-layer bag material 6 and the tubular synthetic resinous film 7. The inner support plate 10 has an L-shaped cross-sectional shape and is arranged to extend along the outer side edge of the lower guide plate 1, for support, from the inside, the upstanding section 8' of the tubular synthetic resinous film 7. An outer support frame 11 is arranged downstream of the inner support plate 10 and extends between the side guide plate 2 and the upper guide plate 5, for supporting, from the outside, the upstanding section 8' of the tubular synthetic resinous film 7.

A disc-shaped engaging flare member 12 is mounted, through an attaching plate 13, to the lower surface of the upper guide plate 5 at a location downstream of the outer support frame 11 in such a manner that the engaging flare member 12 has a slope inclined with respect to the lower guide plate 1. A plurality of rotary rolls 14, 15 and 16 are rotatably arranged between the side guide plate 2 and the upper guide plate 5 and downstream of the engaging flare member 12. The rotary rolls 14, 15 and 16 are formed respectively by discs different in diameter from each other, for successively folding a part of the outer-layer bag material 6 into a space or root between the pleat crests 8 and 8 of the tubular synthetic resinous film 7. The diameters of the espective rotary rolls 14, 15 and 16 increase stepwise from the one end 1*a* of the lower guide plate 1 toward the other end 1*b* thereof. By the rotary roll 16 closest to the other end 1*b* of the lower guide plate 1, a folded-in section 17 of the outer-layer bag material 6, which has a predetermined depth, is formed between and along the pleat crests 8 and 8 of the tubular synthetic resinous film 7.

A section 18 bent upwardly is provided at the one end 1*a* of the lower guide plate 1, for guiding the tubular synthetic resinous film 7 into a gap between the lower guide plate 1 and the table (not shown). A section 19 inclined upwardly is formed at the one end of the side guide plate 2, for guiding the outer-layer bag material 6 and the side edge of the tubular synthetic resinous film 7 into a gap between the side guide plate 2 and the table.

The pleated multilayer bag is manufactured by the bag manufacturing device constructed as above, in the following manner. First, the tubular synthetic resinous film 7, which is collapsed flatly and in which each side edge is folded inwardly to form the pair of pleat crests 8 and 8 extending the side edge, is superimposed upon the outer-layer bag material 6. One of the pair of pleat crests 8 and 8 on each side of the tubular synthetic resinous film 7 is set upright to form the upstanding section 8'. Subsequently, the outer-layer bag material 6 and the tubular synthetic resinous film 7 superimposed one upon the other are fed, from the one ends of the respective lower and side guide plates 1 and 2, into the gaps between the respective lower and side guide plates 1 and 2 and the table in such a manner that the upstanding section 8' of the tubular synthetic resinous film 7 are inserted into the engaging groove 3 between the lower guide plate 1 and the side guide plate 2.

Subsequently, the outer-layer bag material 6 and the tubular synthetic resinous film 7 are transported simultaneously by the transport device (not shown) along the lower guide plate 1, the side guide plate 2 and the upper guide plate 5 in the direction indicated by the arrow a in FIG. 2. First, as shown in FIG. 4-*a*, the upstanding section 8' of the tubular synthetic resinous film 7 moving along the engaging groove 3 passes through a downwardly opening recess 9*a* of the support frame 9 mounted to the respective upper surfaces of the lower guide plate 1 and the side guide plate 2. During the passage of the upstanding section 8' through the recess 9*a*, the support frame 9 supports, from both sides, the upstanding section 8' of the tubular synthetic resinous film 7. A side portion 6*a* of the outer-layer bag material 6 is folded back toward the upstanding section 8' of the tubular synthetic resinous film 7.

The upstanding section 8' of the tubular synthetic resinous film 7 having passed through the support frame 9 is further transported along the engaging groove 3 in the direction indicated by the arrow a in FIG. 2. Meanwhile, as shown in FIG. 4-*b*, a bent section 10*a* of the inner support plate 10 mounted to the upper surface of the lower guide plate 1 at the location adjacent to the outer side edge thereof supports, from the inside, the upstanding section 8' of the tubular synthetic resinous film 7. The side portion 6*a* of the outer-layer bag material 6 is further folded back toward the upstanding section 8' of the tubular synthetic resinous film 7. Subsequently, as shown in FIG. 4-*c*, the outer support frame 11 is mounted on the side guide plate 2 and extends from the outer side edge of the engaging groove 3 to the upper guide plate 5 through an area above the engaging groove 3 supports, from the outside, the upstanding section 8' of the tubular synthetic resinous film 7 which moves along the engaging groove 3. The side portion 6*a* of the outer-layer bag material 6 is further folded back toward the upstanding section 8' of the tubular synthetic resinous film 7. The opposite side faces of the upstanding section 8' of the tubular synthetic resinous film 7 are supported respectively by the bent section 10*a* of the inner support plate 10 and an upstanding wall 11*a* of the outer support frame 11.

The upstanding section 8' of the tubular synthetic resinous film 7 having passed through the outer support frame 11 is further transported along the engaging groove 3 in the direction indicated by the arrow a in FIG. 2. In the meantime, as shown in FIG. 4-*d*, the upstanding section 8' of the tubular synthetic resinous film 7 is folded down toward the side portion 6*a* of the outer-layer bag material 6 by the slope of the engaging flare member 12 mounted on the lower surface of the upper guide plate 5. On the other hand, the rotating rotary roll 14 arranged between the side guide plate 2 and the upper guide plate 5 forces a part of the side portion 6*a* of the outer-layer bag material 6, into a space or root between the upstanding section 8' and the lower pleat crest 8 of the tubular synthetic resinous film 7.

The upstanding section 8' of the tubular synthetic resinous film 7 having passed through the rotary roll 14 is further transported along the engaging groove 3 in the direction indicated by the arrow a in FIG. 2. Meanwhile, as shown in FIG. 4-*e*, the rotating rotary roll 15 arranged between the side guide plate 2 and the upper guide plate 5 at the location between the rotary rolls 14 and 16 further forces the part of the side portion 6*a* of the outer-layer bag material 6, into the space between the upstanding section 8' and the lower pleat crest 8 of the tubular synthetic resinous film 7. On the other hand, the upstanding section 8' of the tubular synthetic resinous film 7 is folded down toward the lower pleat crest 8 by the upper guide plate 5. The side portion 6*a* of the outer-layer bag material 6 is folded back toward the upper surface of the upper guide plate 5. Subsequently, as shown in FIG. 4-*f*, the rotary roll 16 located closest to the other end of the side guide plate 2 largely forces the part of the side portion 6*a* of the outer-layer bag material 6 into the space between the upstanding section 8' and the lower pleat crest 8 of the tubular synthetic resinous film 7, thereby forming the folded-in section 17 having the predetermined depth. The side portion 6*a* of the outer-layer bag material 6 is folded over the upper surface of the upper guide plate 5, so that the outer-layer bag material 6 extends along the outer peripheral surface of the tubular synthetic resinous film 7.

After the outer-layer bag material 6 has been folded back to extend along the outer peripheral surface of the tubular synthetic resinous film 7 in such a manner that the tubular synthetic resinous film 7 serves as an inner layer, the opposite side portions of the outer-layer bag material 6 are stuck together to form the same into a tube. Subsequently, the outer-layer bag material 6 and the tubular synthetic resinous film 7, which are united together, are cut into pieces each having a predetermined length. The cut pieces are then transported to the subsequent processing step where one end of each cut piece is processed to form a multilayer bag having a closed bottom.

Figure 5:
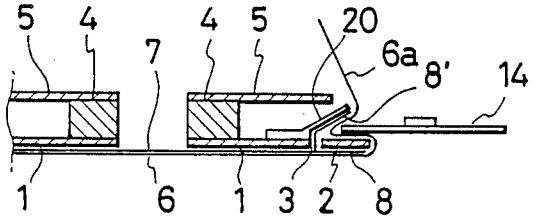
FIG. 5 is a fragmentary view showing another embodiment of the invention, cross-sectioned at a location corresponding to FIG. 4-*d*.
Figure 6:
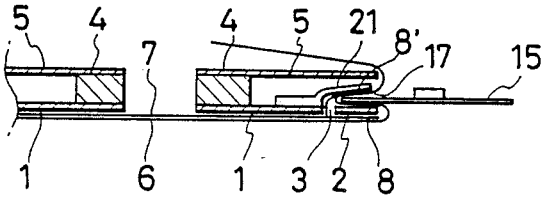
FIG. 6 is a fragmentary view cross-sectioned at a location corresponding to FIG. 4-*e*.

FIGS. 5 and 6 show another embodiment of the invention. As shown in FIG. 5, an engaging flare member 20 is used in substitution for the engaging flare member 12 shown in FIG. 4-*d*. The engaging flare member 20 is mounted to the upper surface of the lower guide plate 1 at a location corresponding to FIG. 4-*d*, in such a manner that the engaging flare member 20 has a slope largely inclined with respect to the side guide plate 2.

In the embodiment illustrated in FIGS. 5 and 6, as the upstanding section 8' of the tubular synthetic resinous film 7 having passed through the outer support frame 11 is transported along the engaging groove 3 in the direction indicated by the arrow a in FIG. 2, the upstanding section 8' of the tubularsynthetic resinous film 7 is folded down toward the folded-in part 17 of the side portion 6*a* of the outer-layer bag material 6, by the slope of the engaging flare member 20 mounted to the upper surface of the lower guide plate 1, as shown in FIG. 5. The rotating rotary roll 14 arranged between the side guide plate 2 and the upper guide plate 5 forces the the folded-in part 17 of the side portion 6*a* of the outer-layer bag material 6, into the space between the upstanding section 8' and the lower pleat crest 8 of the tubular synthetic resinous film 7.

As shown in FIG. 6, an engaging guide piece 21 having a slope slightly inclined with respect to the side guide plate 2 is mounted on the upper surface of the lower guide plate 1 at a location corresponding to FIG. 4-*e*.

The upstanding section 8' of the tubular synthetic resinous film 7 having passed through the rotary roll 14 is further transported along the engaging groove 3 in the direction indicated by the arrow a in FIG. 2. In the meantime, the upstanding section 8' of the tubular synthetic resinous film 7 is further folded down toward the lower pleat crest 8 thereof by the slope of the engaging guide piece 21 mounted to the upper surface of the lower guide plate 1. The rotary roll 15 arranged between the side guide plate 2 and the upper guide plate 5 and located between the rotary rolls 14 and 16 forces the part of the side portion 6*a* of the outer-layer bag material 6 into the space between the upstanding section 8' and the lower pleat crest 8 of the tubular synthetic resinous film 7. The side portion 6*a* of the outer-layer bag material 6 is folded over the upper guide plate 5.

Other aspects of the construction and operation of the embodiment illustrated in FIGS. 5 and 6 are similar to those of the embodiment shown in FIG. 1, and the description of such other construction and operation is therefore omitted to avoid repetition.

Still other objects and advantages of the present invention will become readily apparent to those skilled in this art from the preceding detailed description, wherein only the preferred embodiments of the invention are illustrated and described, as aforementioned, simply by way of presenting the best modes contemplated of carrying out the invention. As will be realized, the invention is capable of other and different embodiments, and its several details are capable of modifications in various obvious respects, all without departing from the invention. Accordingly, the drawing and description are to be regarding as illustrative in nature, and not as restrictive, the invention being defined solely by the claims appended hereto.

What is claimed is:

1. A method of manufacturing a pleated multilayer bag, comprising the steps of:

preparing a tubular synthetic resinous film collapsed flatly, each of opposite side edges of the collapsed film being folded inwardly to form a pair of pleats extending along the side edge;

superimposing said film upon an outer-layer bag material;

transporting said film and said outer-layer bag material, superimposed one upon the other, while setting only one of the pair of pleats at each side edge of said film substantially normal to the rest of the film to form an upstanding section;

subsequently, folding back opposite side portions of said outer-layer bag material respectively toward the upstanding sections at the respective side edges of said film;

folding down the upstanding pleat at each side edge of said film toward the other pleat at the corresponding side edge;

forcing a part of each of the opposite side portions of said outer-layer bag material, into a space between the pair of pleats at a corresponding one of the opposite side edges of said outer-layer bag material; and folding the opposite side portions of said outer-layer bag material over said film in such a manner that the folded side portions of said outer-layer bag material extend along an outer surface of said film said succession of steps being performed with said film and said pairs of pleats thereof being maintained in their collapsed state, wherein the upstanding pleats at the respective side edges of said film are transported in such a manner that the upstanding pleats are inserted respectively into a pair of engaging grooves defined respectively between a pair of lower guide plates and a pair of side guide plates, and the upstanding pleats at the respective side edges of said film are caused to pass respectively through a pair of recesses which open downwardly, each of said pair of recesses being defined by a support frame which is mounted to an upper surface of a corresponding one of said pair of lower guide plates and an upper surface of a corresponding one of said pair of side guide plates.

2. A manufacturing method according to claim 1, wherein:

the upstanding pleat at each side edge of said film is further transported while being supported by a bent section of a corresponding one of said pair of lower guide plates, an inner support plate being mounted to the upper surface of a corresponding one of said pair of lower guide plates, said inner support plate being arranged adjacent and along an outer side edge of the corresponding lower guide plate, which is located adjacent a corresponding one of said pair of side guide plates.

3. A manufacturing method according to claim 2, wherein:

the upstanding pleats at the respective side edges of said film are further transported while being supported respectively by a pair of outer support frames, each of said pair of outer support frames extending from a corresponding one of said pair of side guide plates so as to cover an outer side edge of a corresponding one of said pair of engaging grooves and an area above the engaging groove, the outer side edge of the engaging groove being located adjacent to the side guide plate.

4. A manufacturing method according to claim 3, wherein:

the upstanding pleats at the respective side edges of said film are folded down respectively toward the opposite side portions of said outer-layer bag material, along and by respective slopes of a pair of engaging flare members, and wherein a corresponding part of each of the respective opposite side portions of said outer-layer bag material is forced into the space between the upstanding section and the other pleat at a corresponding one of the opposite side edges of said film, by a corresponding one of a pair of rotary rolls.

5. A manufacturing method according to claim 4, wherein:

said part of each of said opposite side portions of said outer-layer bag material is further forced into the space between the upstanding pleat and the other pleat at a corresponding one of the opposite side edges of said film, by another rotary roll, wherein the upstanding pleat at each of the opposite side edges of said film is folded down by a corresponding one of said pair of upper guide plates, toward a crest of the other pleat at the side of said film, and wherein the opposite side portions of said outer-layer bag material are folded respective over said paid of upper guide plates.

6. A manufacturing method according to claim 4, wherein:

said pair of engaging flare members are mounted respectively to said pair of upper guide plates.

7. A manufacturing method according to claim 4, wherein:

said pair of engaging flare members are mounted respectively to said pair of lower guide plates.

8. A manufacturing method according to claim 7, wherein:

the upstanding pleat at each side edge of said film is further folded down toward a crest of the other pleat at the side edge of said film, by a corresponding one of a pair of engaging guide pieces mounted respectively to said pair of lower guide plates.

* * * * *